US012660964B2

(12) United States Patent
Garris

(10) Patent No.: US 12,660,964 B2
(45) Date of Patent: Jun. 23, 2026

(54) SHOWER SCREEN DEVICE

(71) Applicant: BathLab LLC, Austin, TX (US)

(72) Inventor: Jeffrey Todd Garris, Austin, TX (US)

(73) Assignee: BathLab LLC, Austin, TX (US)

( * ) Notice: Subject to any disclaimer, the term of this patent is extended or adjusted under 35 U.S.C. 154(b) by 0 days.

(21) Appl. No.: 19/296,691

(22) Filed: Aug. 11, 2025

(65) Prior Publication Data

US 2025/0359712 A1 Nov. 27, 2025

Related U.S. Application Data

(63) Continuation-in-part of application No. 29/847,875, filed on Jul. 28, 2022, and a continuation-in-part of application No. 17/859,739, filed on Jul. 7, 2022, now abandoned, said application No. 29/847,875 is a continuation-in-part of application No. 17/859,739, filed on Jul. 7, 2022, now abandoned.

(51) Int. Cl.
*A47K 3/34* (2006.01)

(52) U.S. Cl.
CPC ..... *A47K 3/34* (2013.01)

(58) Field of Classification Search
CPC ... A47K 3/30; A47K 3/34; A47K 3/36; A47K 3/362; A47K 3/38; A47K 2003/365; A47K 2003/367
See application file for complete search history.

(56) References Cited

U.S. PATENT DOCUMENTS

| | | | | | |
|---|---|---|---|---|---|
| 2,095,645 | A * | 10/1937 | Lewis | A47K 3/34 | 4/607 |
| 2,380,665 | A * | 7/1945 | Claremont | A47K 3/30 | 4/558 |
| 3,180,495 | A * | 4/1965 | Schumann | A47K 3/30 | 248/214 |
| 3,688,341 | A | 9/1972 | Peckham | | |
| 4,073,331 | A | 2/1978 | Zilver | | |
| 5,191,922 | A | 3/1993 | Wade | | |
| 5,402,842 | A | 4/1995 | Ruggiero | | |
| 5,794,281 | A * | 8/1998 | Shearon | A47K 3/38 | 4/558 |
| 6,564,851 | B1 | 5/2003 | Liao | | |

(Continued)

FOREIGN PATENT DOCUMENTS

EP 0330014 A1 * 8/1989 ..... A47K 3/362

*Primary Examiner* — Erin Deery

(57) ABSTRACT

A shower screen device comprising at least one horizontally mounted shower rod and at least one divider assembly translationally coupled thereto. The divider assembly comprises a plurality of translatory attachment mechanisms engaging the shower rod via a rod interface selected from a hook or castor. Each attachment mechanism is coupled to a vertical member hingedly connected to a horizontal member via a hinge comprising an internal channel and axis of rotation. A panel composed of a material impervious to water spans between the horizontal members, held taut and uniplanar by fasteners disposed along a top edge. The hinges enable a 90-degree degree of freedom. A window is defined between the rod and horizontal members for airflow. The horizontal members are joined by a detachable connection member for collapsibility. An optional shelving unit comprises a platform supported by attachment members secured to the horizontal members.

20 Claims, 13 Drawing Sheets

(56) References Cited

U.S. PATENT DOCUMENTS

| | | | |
|---|---|---|---|
| 7,431,067 | B2 | 10/2008 | Nien |
| 8,297,335 | B2 | 10/2012 | Bennett et al. |
| 8,910,697 | B1 | 12/2014 | Dollahan Shirk |
| 2006/0021722 | A1 | 2/2006 | Nien |
| 2017/0273492 | A1 | 9/2017 | Hatton et al. |
| 2022/0015565 | A1 | 1/2022 | Olsen et al. |
| 2022/0142390 | A1 | 5/2022 | Sisto |
| 2023/0079958 | A1 | 3/2023 | Ellis et al. |

* cited by examiner

SHOWER SCREEN DEVICE

FIELD OF THE INVENTION

The present invention relates generally to a water screen device for showers. More specifically, the present invention is a device that maintains a flat, unfolded panel, to facilitate airflow and reduce the growth of mold and mildew.

BACKGROUND OF THE INVENTION

Shower enclosures and curtain systems are essential fixtures in residential and commercial bathrooms, designed to prevent water from splashing into the surrounding area during bathing. The most common implementations involve flexible shower curtains suspended from shower rods, often using rings or hooks. These curtains are typically made from polymeric or fabric-based materials and are suspended in a manner that allows them to hang loosely and conform to the perimeter of the bathtub or shower alcove.

A widely recognized issue with conventional shower curtain systems is the accelerated growth of mold, mildew, and bacteria. The internal environment of a shower stall is characteristically warm and humid, conditions that are highly conducive to microbial growth. Traditional curtain systems compound this problem by limiting airflow and natural light penetration into the bathing area. In particular, conventional curtains are prone to folding, draping, and bunching along the rod or wall, which results in overlapping and shadowed regions that retain moisture. These folds not only prevent complete drying of the curtain surface but also create stagnant air pockets, both of which encourage microbial colonization.

The result of this accumulation is often a visible buildup of mildew along the bottom edges and within the folds of the curtain. In many cases, the affected curtain becomes discolored, emits unpleasant odors, and must be replaced within a short time frame due to irreversible contamination or degradation. The limited lifespan of these screens leads to increased household waste and recurring expenses. In addition, the aesthetic and sanitary implications of mold-covered curtains are undesirable for users.

While certain manufacturers have attempted to address these issues through the use of antimicrobial coatings or by incorporating heavier bottom hems to reduce billowing and folding, these measures have had limited success. Coated materials eventually degrade with repeated washing, and weighted hems do not resolve the fundamental issues of poor airflow and light obstruction. Furthermore, many current designs completely enclose the shower space, further restricting air exchange and light entry into the alcove.

Another deficiency in conventional shower screen systems is the lack of structural support or rigidity in the curtain material. Most curtain systems are flexible and lack any internal frame or taut support structure, which exacerbates folding and sagging. This lack of structure allows the curtain to cling to the user's body during use—a common user complaint—and increases the surface area that remains wet for extended periods. Moreover, once folded or collapsed, conventional curtains are difficult to dry thoroughly without manual intervention, leaving sections consistently damp and prone to rapid microbial growth.

These limitations have spurred the need for an improved shower screen system that addresses the root causes of mold and mildew formation. An ideal solution would allow for maximum air and light penetration into the bathing alcove, while maintaining sufficient coverage to prevent water spray into the bathroom. In addition, the solution should ensure that the shower screen remains taut and planar during and after use, thereby allowing faster drying of the screen surface and reducing areas where water may pool or become trapped.

The present invention seeks to overcome these deficiencies in the prior art. The disclosed shower screen device comprises at least one horizontally mounted shower rod and a divider assembly capable of translational movement along the rod. The divider assembly includes a rigid panel mounted to a set of vertical and horizontal members, which are connected via hinges and supported by translatory attachment mechanisms such as hooks or castors. These components allow the panel to remain taut and uniplanar during use, eliminating folding and sagging. The rigid structural members, combined with fasteners such as snap buttons or hook-and-loop systems, ensure that the panel stays firmly in position.

A significant feature of the present invention is the incorporation of a window—an intentional opening formed between the top horizontal frame and the shower rod—which promotes air exchange between the stall and the surrounding environment. This design mitigates the accumulation of humid air within the enclosure, enhancing airflow and accelerating the drying process for the panel and interior surfaces. By enabling greater exposure to ambient light and air, the system discourages the growth of mold and mildew on the panel material and within the shower stall itself.

Additionally, the present invention significantly enhances the user experience related to installing, removing, and cleaning shower enclosures by simplifying attachment procedures. Traditional shower curtain systems require users to manually fasten numerous individual rings or hooks onto a shower rod, a process that is often cumbersome, time-consuming, and tedious. In contrast, the invention utilizes a streamlined framework designed to minimize the number of attachment points, for example employing only two simple snaps to secure the rigid panel. This design substantially reduces the effort and time required for initial installation, routine removal for cleaning, or complete replacement of the shower enclosure. The reduction in complexity and physical exertion not only makes regular maintenance more convenient but also encourages more frequent cleaning, thereby further promoting hygienic conditions within the shower area.

Further, the present invention allows for modularity, wherein multiple divider assemblies can be mounted along multiple parallel shower rods to enclose larger or variably shaped alcove spaces. The device's rigid horizontal members can be detached from one another using a connection member, allowing the unit to be compacted for storage or shipping, which further distinguishes it from existing systems.

In sum, the disclosed invention addresses critical shortcomings in the prior art by improving airflow, enabling light penetration, and structurally supporting the shower panel to prevent draping. These enhancements serve to reduce mold and mildew growth, extend the life of the shower screen, and improve user hygiene and satisfaction.

DETAIL DESCRIPTIONS OF THE INVENTION

Figure 1:
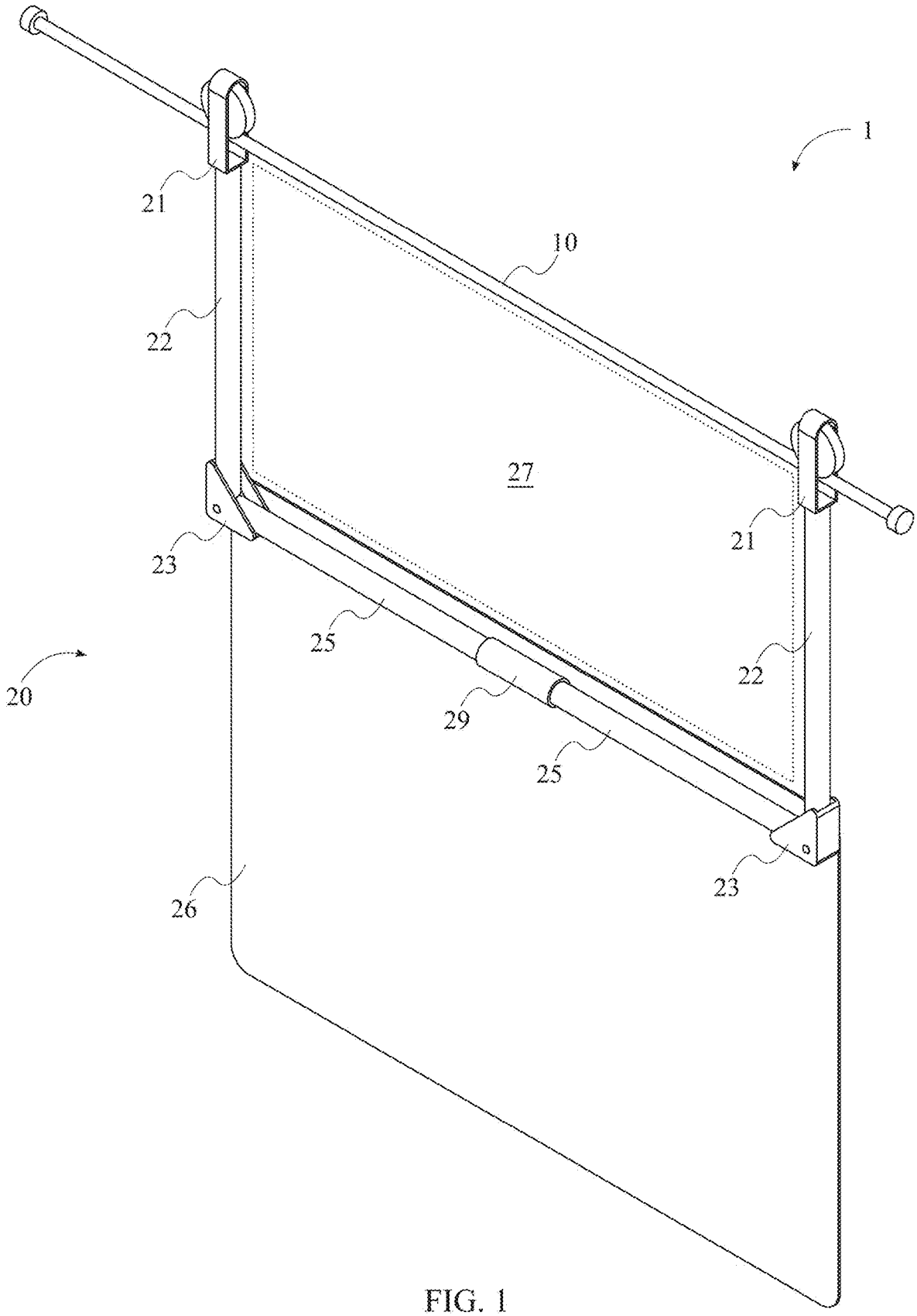
FIG. 1 is a perspective view of the present invention.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term-differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

The present disclosure includes many aspects and features. Moreover, while many aspects and features relate to, and are described in the context of a shower screen device, embodiments of the present disclosure are not limited to use only in this context.

As shown in FIG. 1, the present invention is a shower screen device comprising an at least one shower rod and an at least one divider assembly. In the context of the present invention, the at least one divider assembly is adjustable coupled to the at least one shower rod such that the at least one divider is able to freely move in a translatory motion along the at least one shower rod.

Furthermore, within the context of the present invention, the at least one divider reduces the environmental footprint of traditional shower curtains by reducing the material required to practice the present invention. Furthermore, the at least one divider assembly enables airflow by preventing the formation of non-accessible areas, such as folds or drapes, wherein airflow is restricted to such non-accessible areas. Furthermore, the at least one divider assembly, in relation to the at least one shower rod enables light and air to access portions of the environment in which the present invention is used not enabled by the prior art.

Furthermore, as shown in FIG. 1, in the preferred embodiment of the present invention, the at least one divider assembly comprises a plurality of translatory attachment mechanisms, a plurality of vertical members, a plurality of hinges, a plurality of horizontal members, a panel, and a window. In the context of the present invention, each translatory attachment mechanism of the plurality of translatory attachment mechanisms are coupled to a respective vertical member of the plurality of vertical members. Further, within the context of the present invention, each vertical member extends downwardly from the respective translatory attachment mechanism. Each vertical member and each horizontal member are hingedly coupled to a respective hinge of the plurality of hinges such that each horizontal member hinges about an axis, relative to the respective vertical member, about the respective hinge. Furthermore, within the preferred embodiment of the present invention, the panel is fixedly coupled to the divider assembly such that the panel extends alongside the plurality of horizontal members. In the context of the present invention, the panel is held tautly to the divider assembly such that the panel remains uniplanar. In the context of the present invention, the window is an opening formed by the plurality of vertical members, the plurality of horizontal members, and the at least one shower rod, as shown in FIG. 1. In the context of the present invention, the window is an intentional opening between the at least one shower rod and the plurality of horizontal members thereby preventing the constriction of airflow through the window of the present invention. The present invention seeks to provide a passage of airflow through the window that is substantially greater than the passage of airflow through elements of potential prior art that are otherwise non-hermetically sealed.

Figure 2:
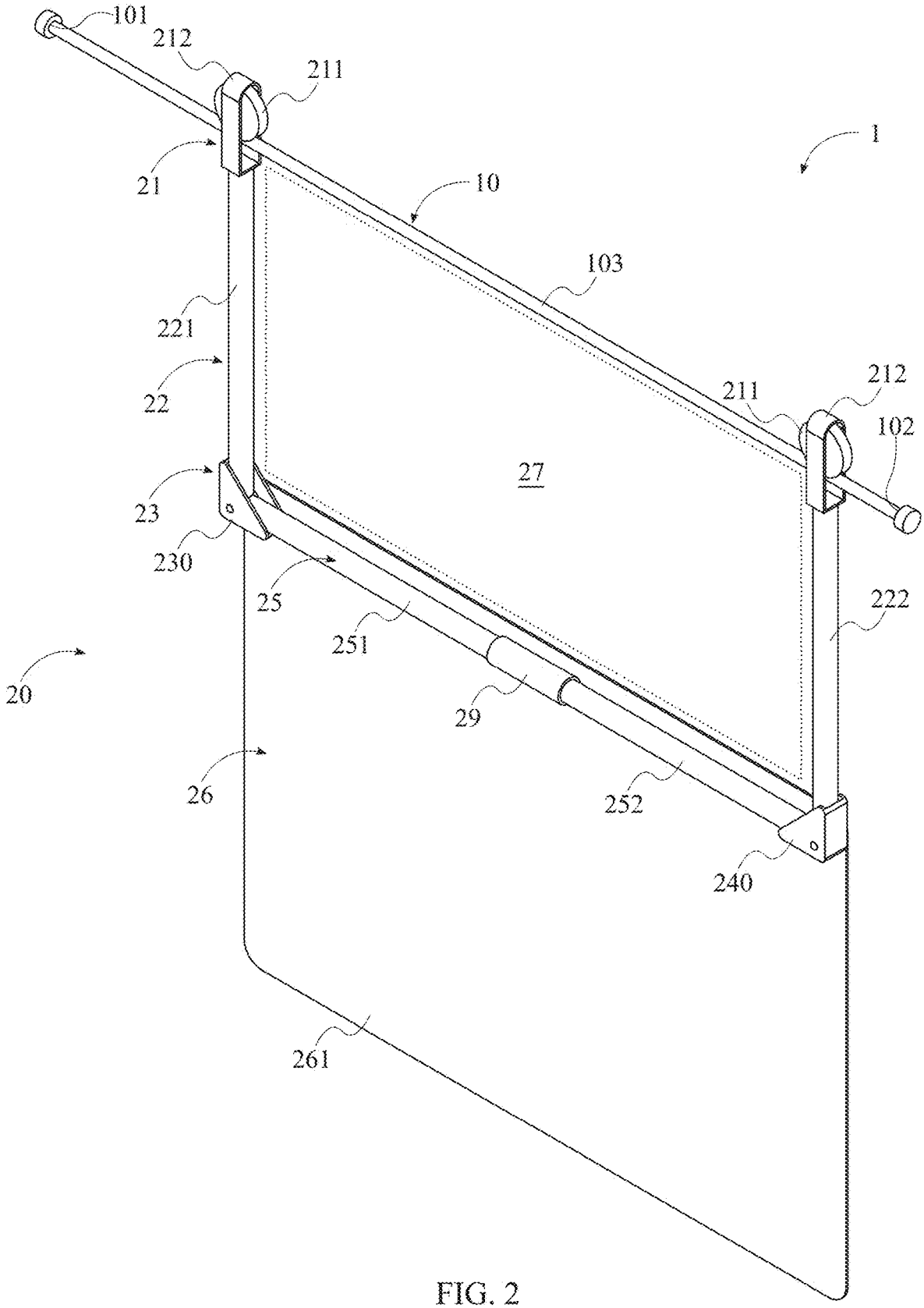
FIG. 2 is an alternate perspective view of the present invention.
Figure 3:
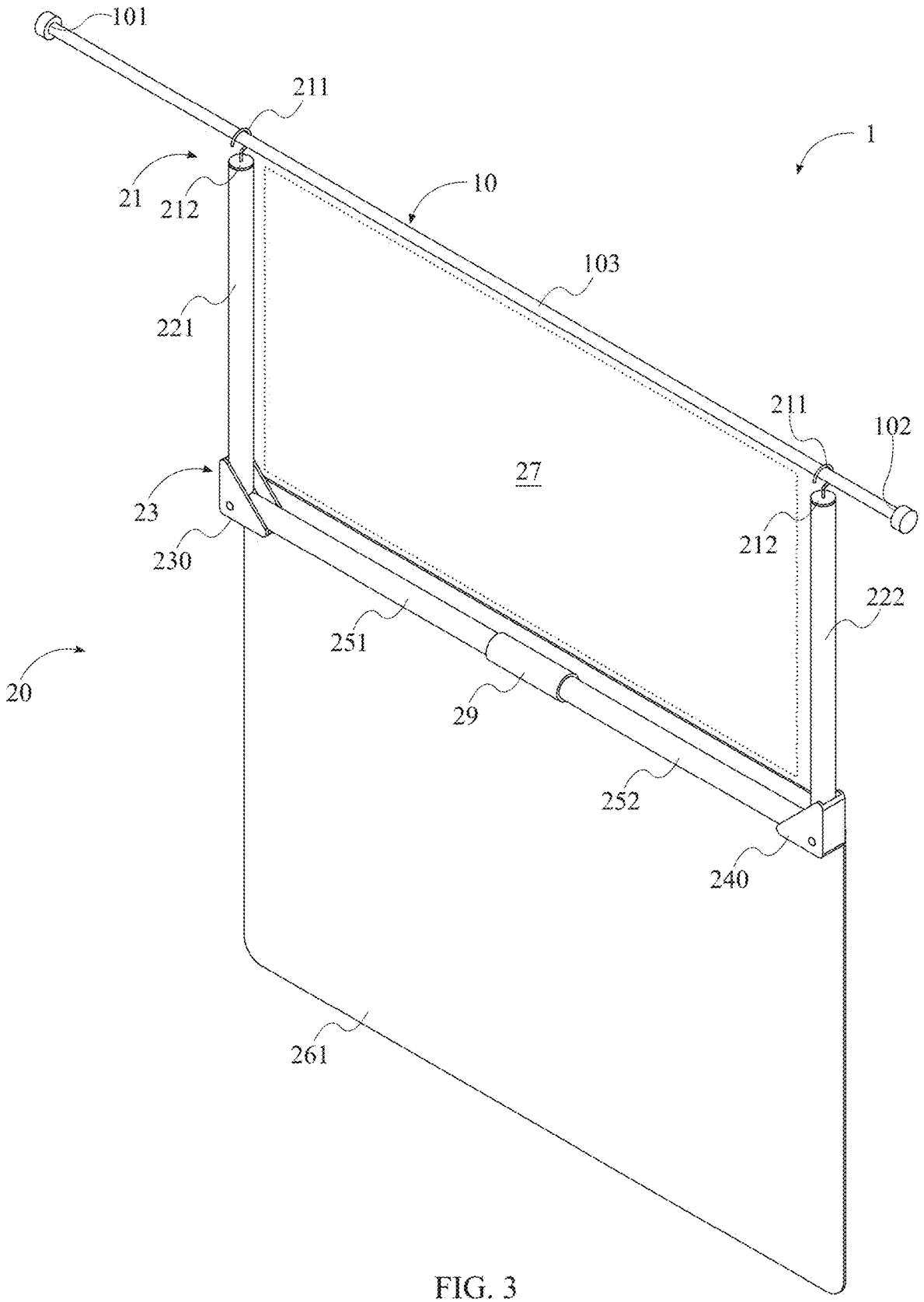
FIG. 3 is a perspective view of an alternate embodiment of the present invention.

Regarding FIG. 2, in the preferred embodiments of the present invention, the at least one shower rod is an elongated horizontally mounted member comprising a first distal end, a second distal end, and a proximal portion. In the context of the present invention, the first distal end of the at least one shower rod and the second distal end of the at least one shower rod are opposing distal ends of the at least one shower rod, separated by the proximal portion. In the context of the present invention, the proximal portion of the at least one shower rod is interposed between the opposing distal ends. Additionally, within the context of the present invention, the at least one divider assembly moves laterally along the at least one shower rod in between the opposing distal ends of the at least one shower rod. More specifically, in the preferred embodiment of the present invention, as shown in FIG. 2 and FIG. 3, in the preferred embodiment of the present invention, the plurality of translatory attachment mechanisms comprise a rod interface and a connector. In the context of the present invention, the rod interface engages with the proximal portion of the at least one shower rod, thereby facilitating movement of the at least one divider assembly. Furthermore, in the context of the present invention, the connector couples to a respective vertical member. As shown in FIG. 2 and FIG. 3, in the preferred embodiment of the present invention, the rod interface is selected from a hook and a castor.

Figure 4:
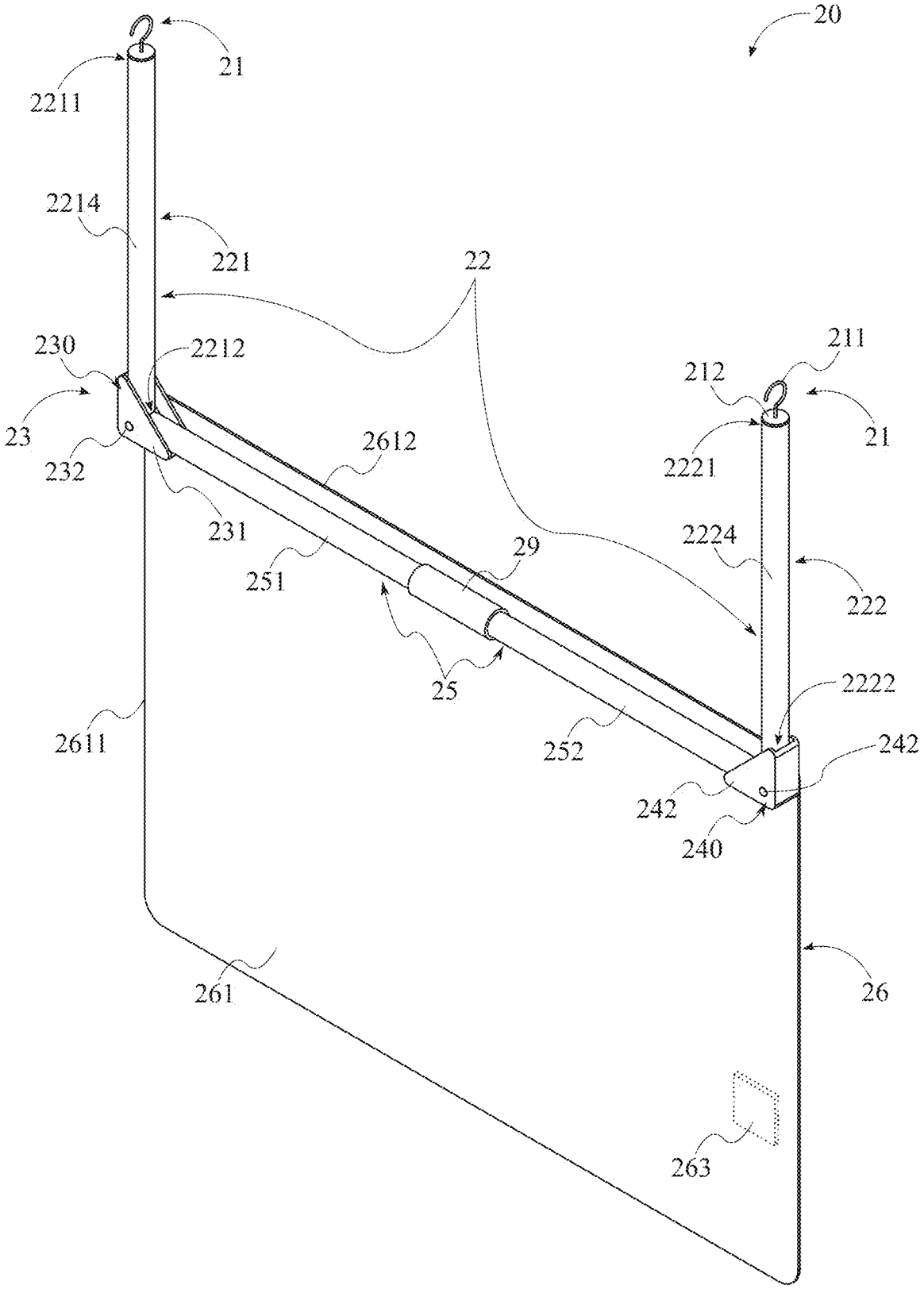
FIG. 4 is a perspective view of the divider assembly of the present invention.
Figure 5:
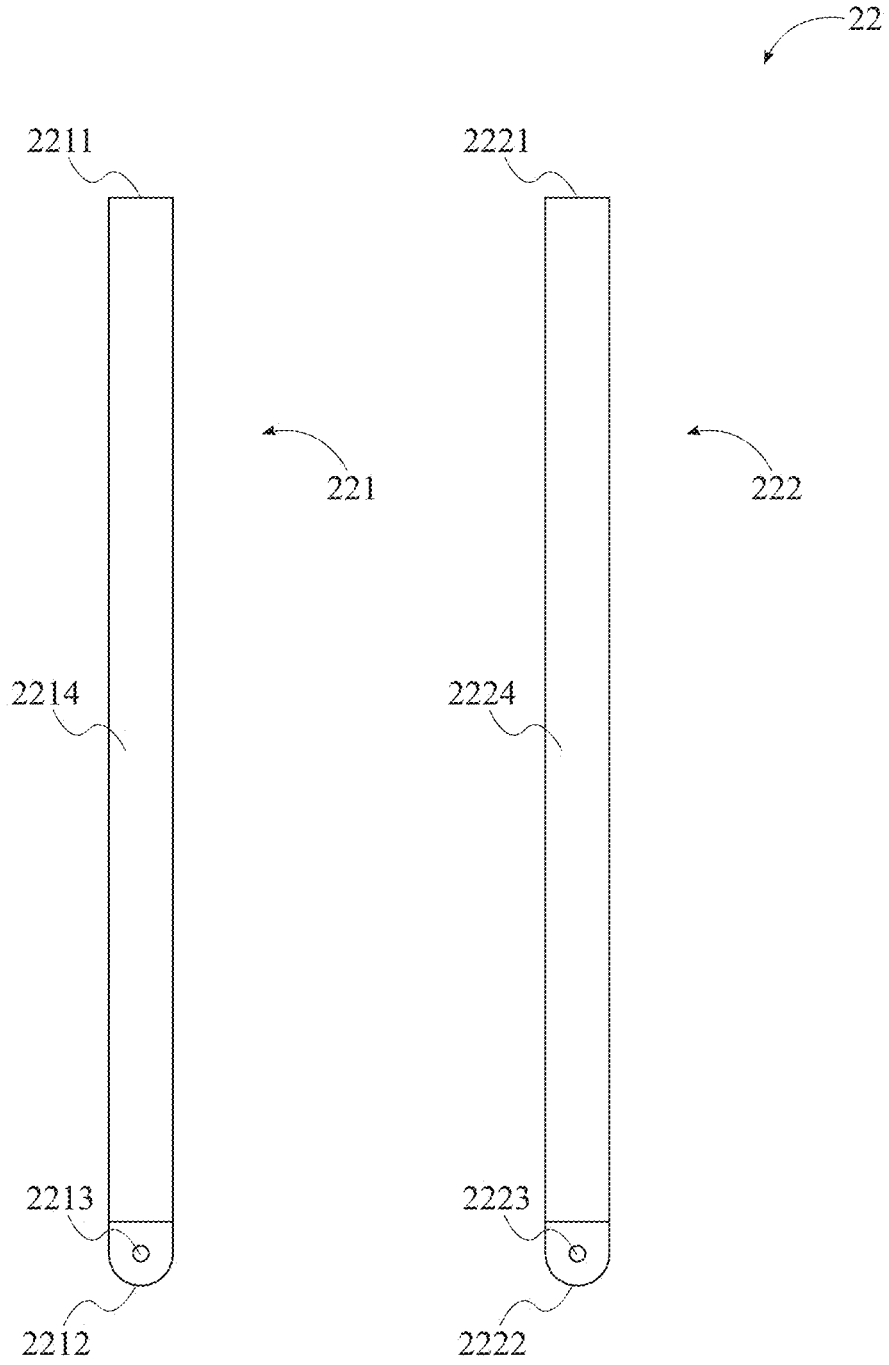
FIG. 5 is a profile view of the plurality of vertical members of the present invention.
Figure 6:
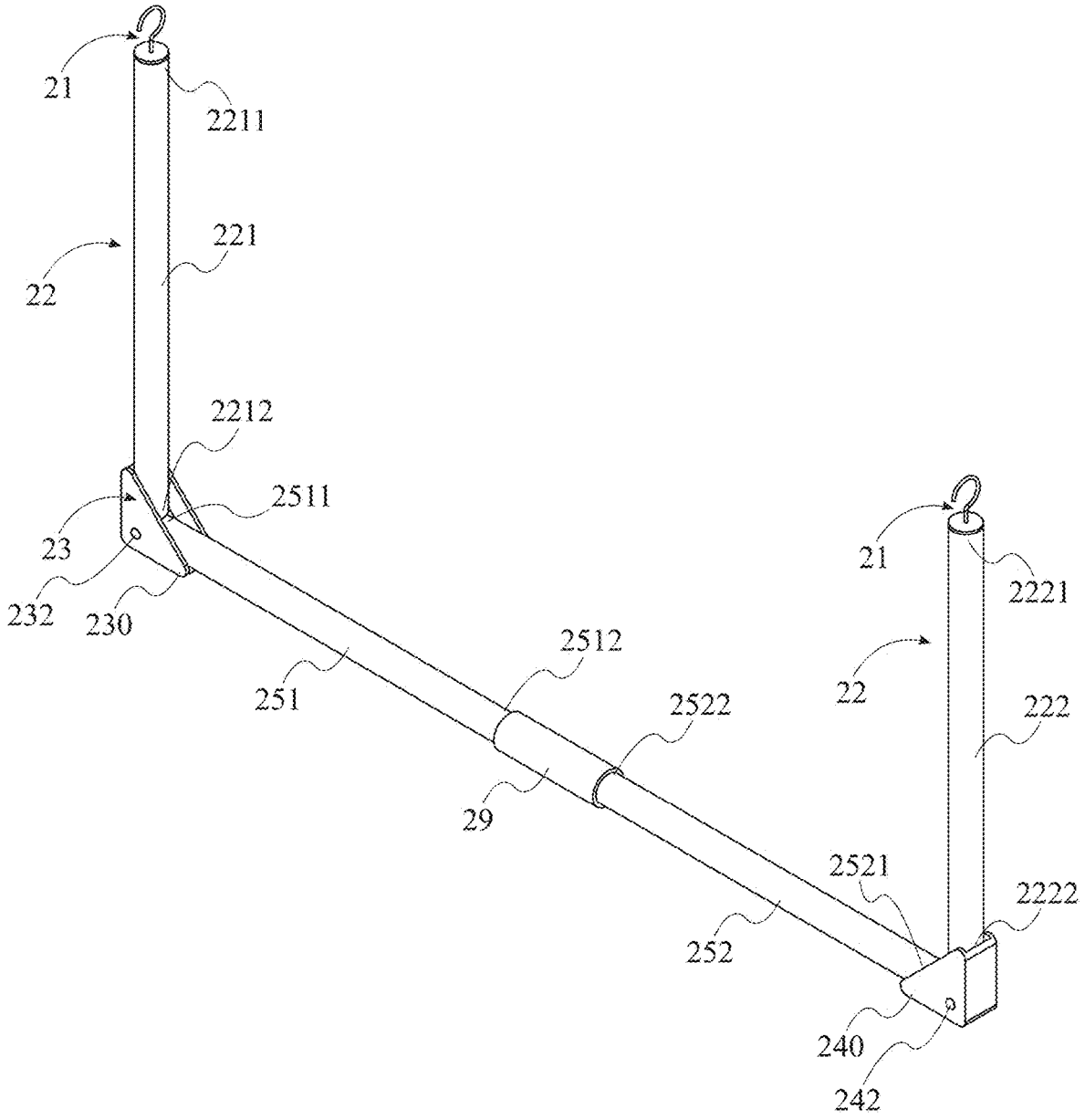
FIG. 6 is a rear perspective view of the plurality of vertical members, the plurality of hinges, and the plurality of horizontal members assembled within the context of the present invention.

As shown in FIG. 4, in the preferred embodiment of the present invention, the plurality of vertical members comprises a first vertical member and a second vertical member wherein said vertical members are parallel to one another. Furthermore, within the preferred embodiment of the present invention, the plurality of hinges comprises two hinges, a first hinge and a second hinge, as shown in FIG. 4. As shown in FIG. 5 and FIG. 6, in the preferred embodiment of the present invention, the first vertical member comprises a first end and a second end wherein said first end and second end of the first vertical member are opposing distal ends such that the first end of the first vertical member is coupled to a connector of a translatory attachment mechanism and the second end of the first vertical member is coupled to the first hinge. Likewise, as also shown in FIG. 5 and FIG. 6, in the preferred embodiment of the present invention, the second vertical member comprises a first end and a second end wherein said first end and second end of the second vertical member are opposing distal ends such that the first end of the second vertical member is coupled to a connector of a translatory attachment mechanism and the second end of the second vertical member is coupled to the second hinge. In the preferred embodiment of the present invention, each vertical member is composed of a single straight elongated member comprising a proximal portion wherein the proximal portion comprises a length longer than a width possessed by the vertical member.

Figure 7:
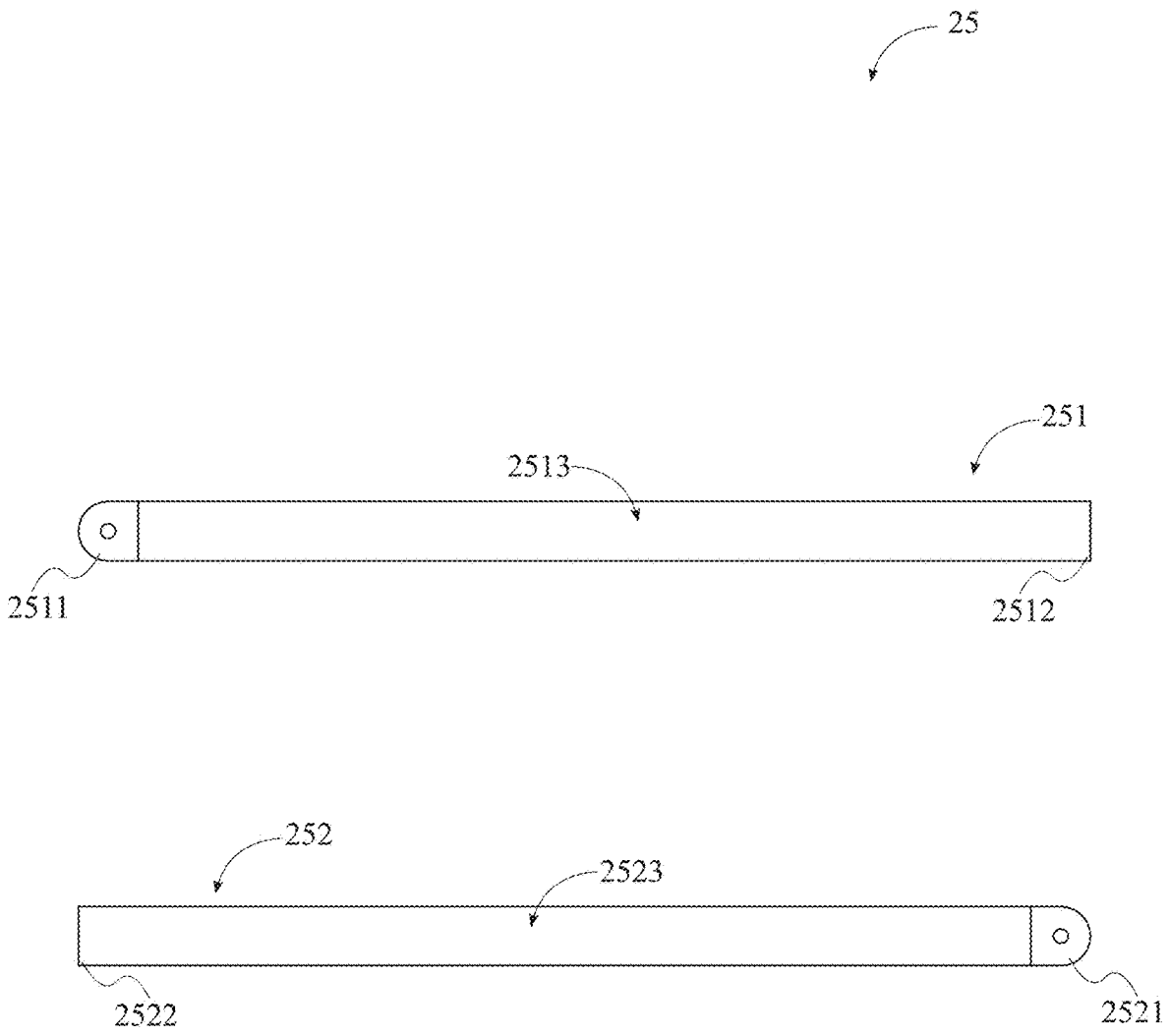
FIG. 7 is a profile view of the plurality of horizontal members of the present invention.
Figure 8:
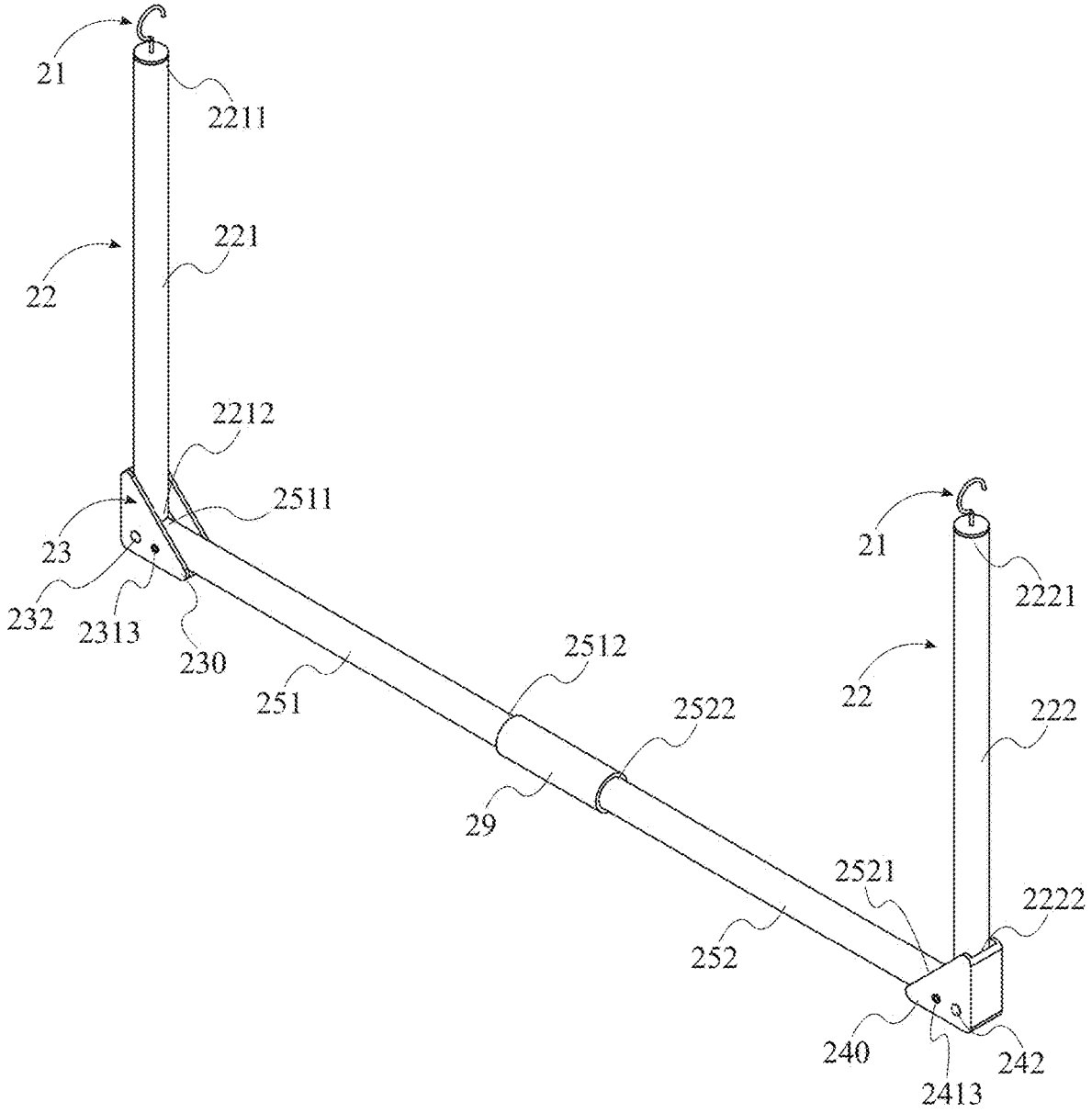
FIG. 8 is a front perspective view of the plurality of vertical members, the plurality of hinges, and the plurality of horizontal members assembled within the context of the present invention.

Furthermore, as shown in FIG. 7 and FIG. 8, in the preferred embodiment of the present invention, the plurality of horizontal members comprises a first horizontal member and a second horizontal member, wherein each horizontal member is a single elongated member. In the preferred embodiment of the present invention, the first horizontal member comprises a first end and a second end wherein said first end and second end of the first horizontal member are opposing distal ends such that the first end of the first horizontal member is coupled to the first hinge and the second end of the first horizontal member extends inwardly. Likewise, as also shown in FIG. 8, in the preferred embodiment of the present invention, the second horizontal member comprises a first end and a second end wherein said first end and second end of the second horizontal member are opposing distal ends such that the first end of the second horizontal member is coupled to the second hinge and the second end of the second horizontal member extends inwardly. In the preferred embodiment of the present invention, the plurality of horizontal members are joined together by a connection member, as shown in FIG. 8. In the preferred embodiment of the present invention, the connection member is a tubular member receiving the second end of the first horizontal member and the second end of the second horizontal member. In the preferred embodiment of the present invention, the plurality of horizontal members are detachable from the connection member to enable a user to reduce the overall size of the present invention for storage and shipping purposes.

Figure 9:
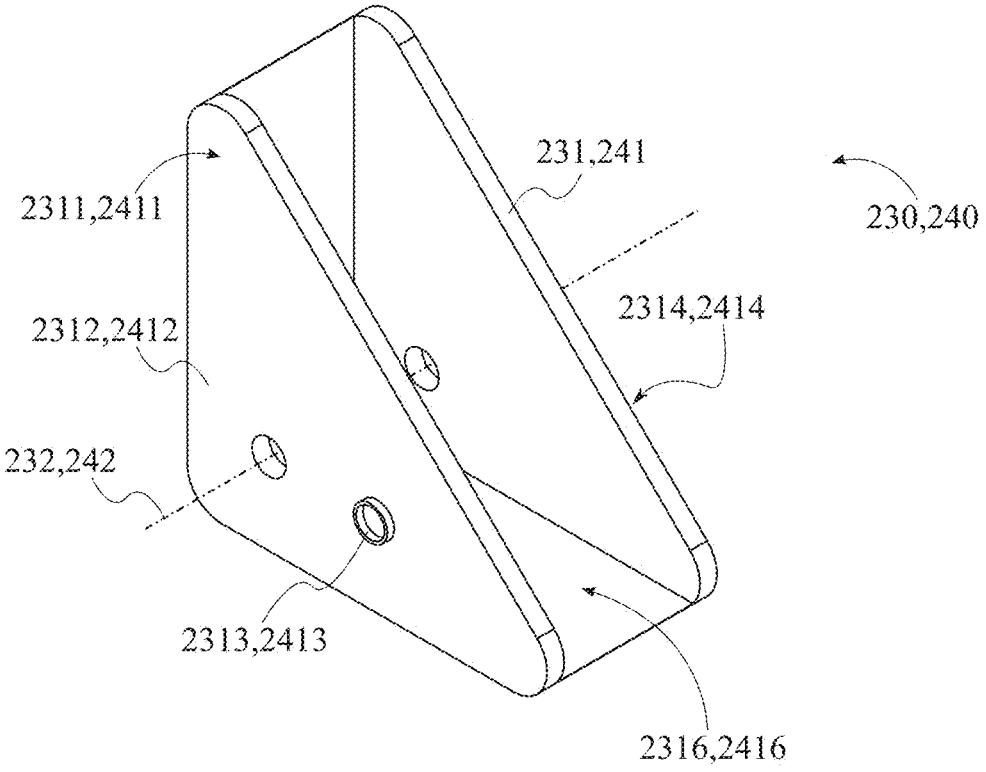
FIG. 9 is a perspective view of the hinge of the present invention.

As shown in FIG. 9, each hinge comprises a hinge frame wherein said hinge frame comprises an external surface, an internal channel, and an axis of rotation. In the context of the present invention, the external surface is the outwardly facing surfaces of the respective hinge. Furthermore, in the preferred embodiment of the present invention, the external surface of each hinge comprises a front surface and a rear surface wherein the preferred embodiment, the front surface comprises an at least one fastener. In the preferred embodiment of the present invention, the at least one fastener is a fixed position fastener for maintaining the panel in a taut and fixed configuration. In some embodiments of the present invention, the at least one fastener is selected from a snap button and a hook and loop fastener. In the context of the present invention, the plurality of vertical members and the respective horizontal members hingedly engage within the internal channel of the hinge frame such that rotation of both the plurality of vertical members and the plurality of horizontal members is about the axis of rotation. In some embodiments of the present invention, the axis of rotation is maintained by a hinge pin wherein said hinge pin traverses a pin hole in each of the plurality of vertical members and a pin hole in each of the plurality of horizontal members.

Figure 10:
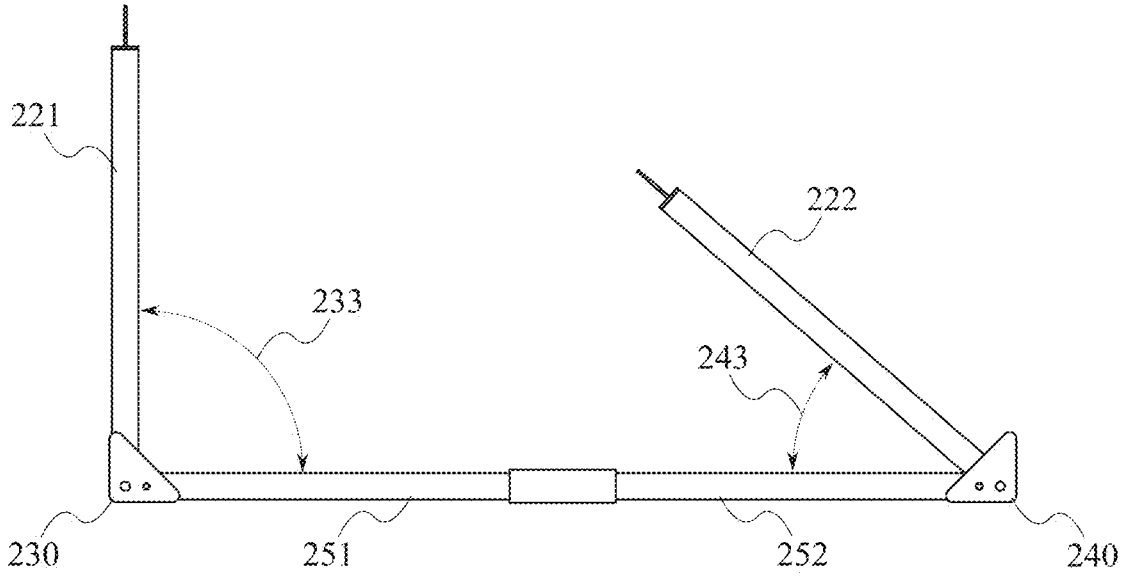
FIG. 10 is a front view of the present invention showing the hinged motion of the plurality of vertical members in relation to the plurality of horizontal members.

Regarding FIG. 10, in the preferred embodiment of the present invention, each hinge further comprises a degree of freedom wherein the degree of freedom is defined as the range of motion allowed between a vertical member and the respective horizontal member. In the preferred embodiment of the present invention, the degree of freedom for each hinge is 90 degrees such that the maximum angle between the vertical members and the respective horizontal members is perpendicular.

Figure 11:
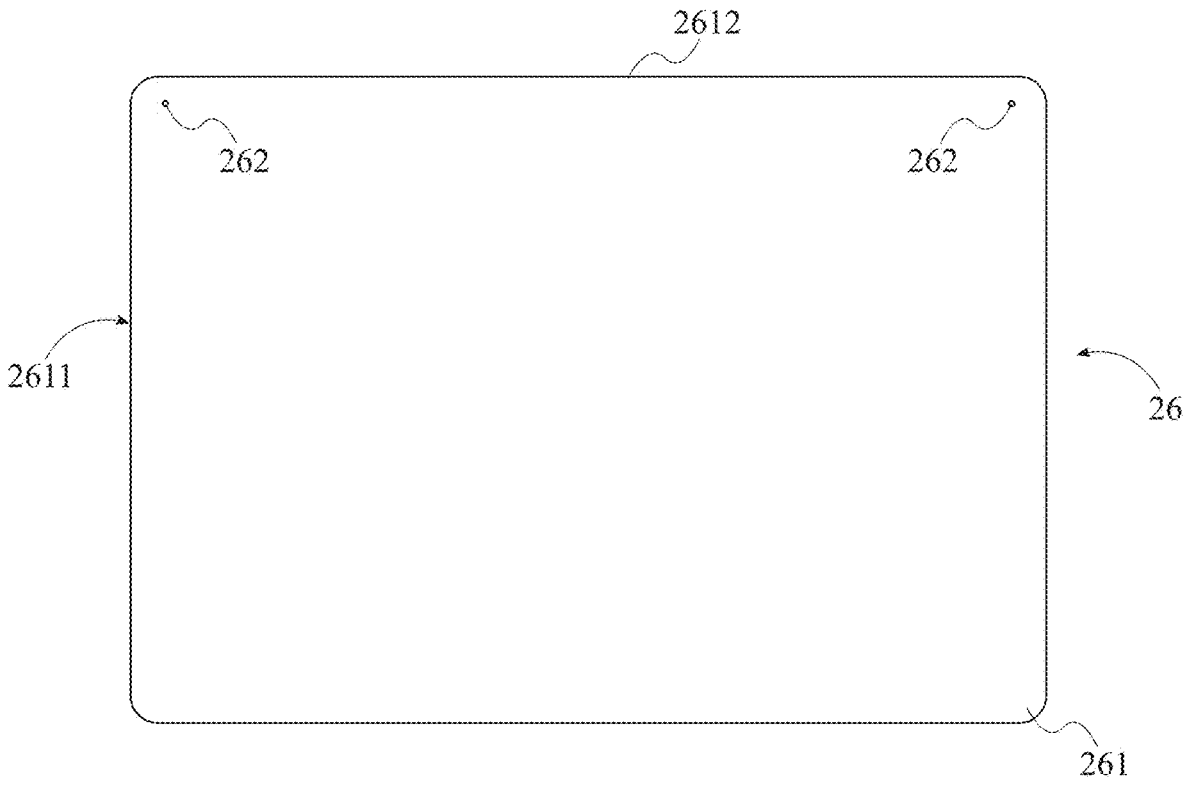
FIG. 11 is a rear view of the panel of the present invention.

Regarding FIG. 11, in the preferred embodiment of the present invention, the panel is a rectangular sheet composed of a material. In the preferred embodiment of the present invention, the material is a material impervious to water such as ethylene vinyl acetate (EVA). Furthermore, within the context of the present invention, the material is selected from a rigid material and a flexible material. Additionally, within the preferred embodiment of the present invention, the panel comprises a plurality of edges wherein said edges composed the outward-most perimeter of the panel. Within the preferred embodiment of the present invention, the plurality of edges comprises a topmost edge. In the context of the present invention, the topmost edge is maintained tautly along the plurality of horizontal members such that the topmost edge is parallel to the plurality of horizontal members. In the preferred embodiment of the present invention the panel further comprises a plurality of fasteners wherein the plurality of fasteners are offset from one another proximate the topmost edge of the panel. Furthermore, within the context of the present invention, the plurality of fasteners on the panel are securable to the fasteners on the plurality of hinges.

Figure 12:
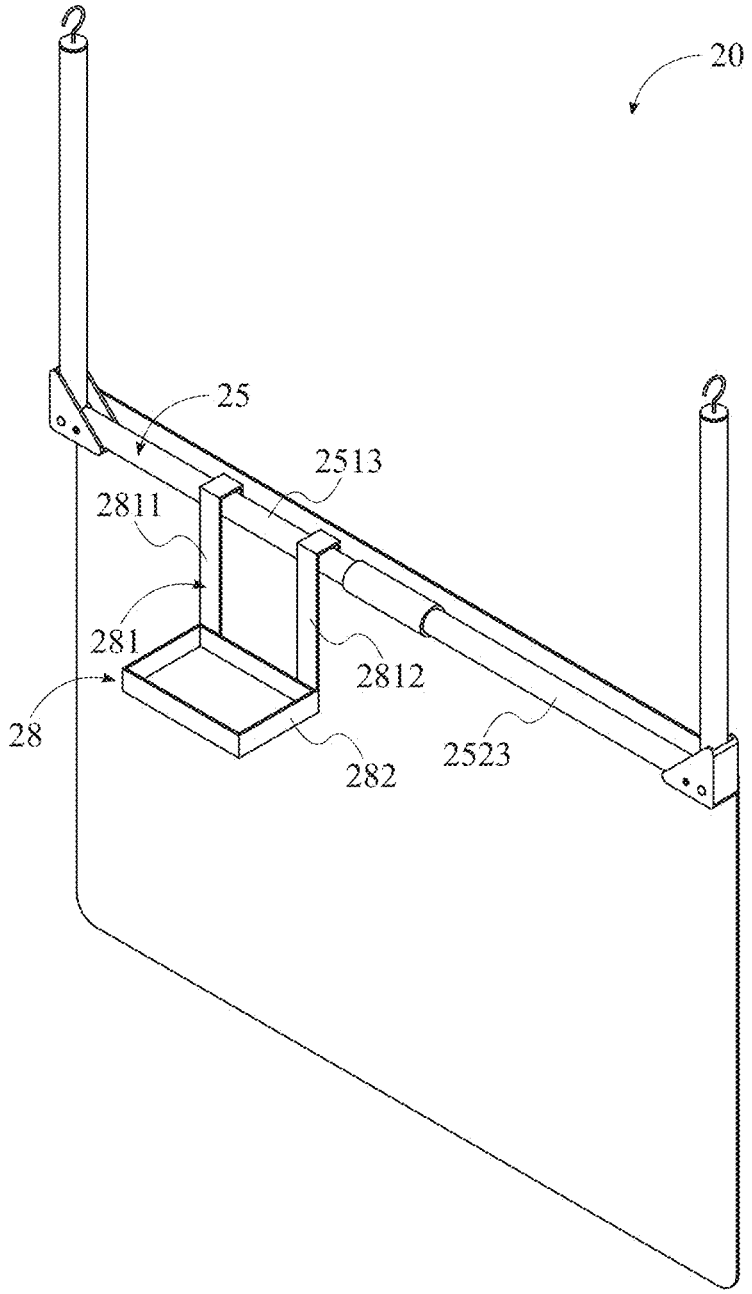
FIG. 12 is a perspective view of the present invention further comprising a shelving unit.

Regarding FIG. 12, in some embodiments of the present invention the shower screen device further comprises a shelving unit comprising an at least one attachment member and a platform. In the context of the present invention, the platform extends perpendicularly from the at least one attachment member wherein said attachment member is supported by the plurality of horizontal members.

Figure 13:
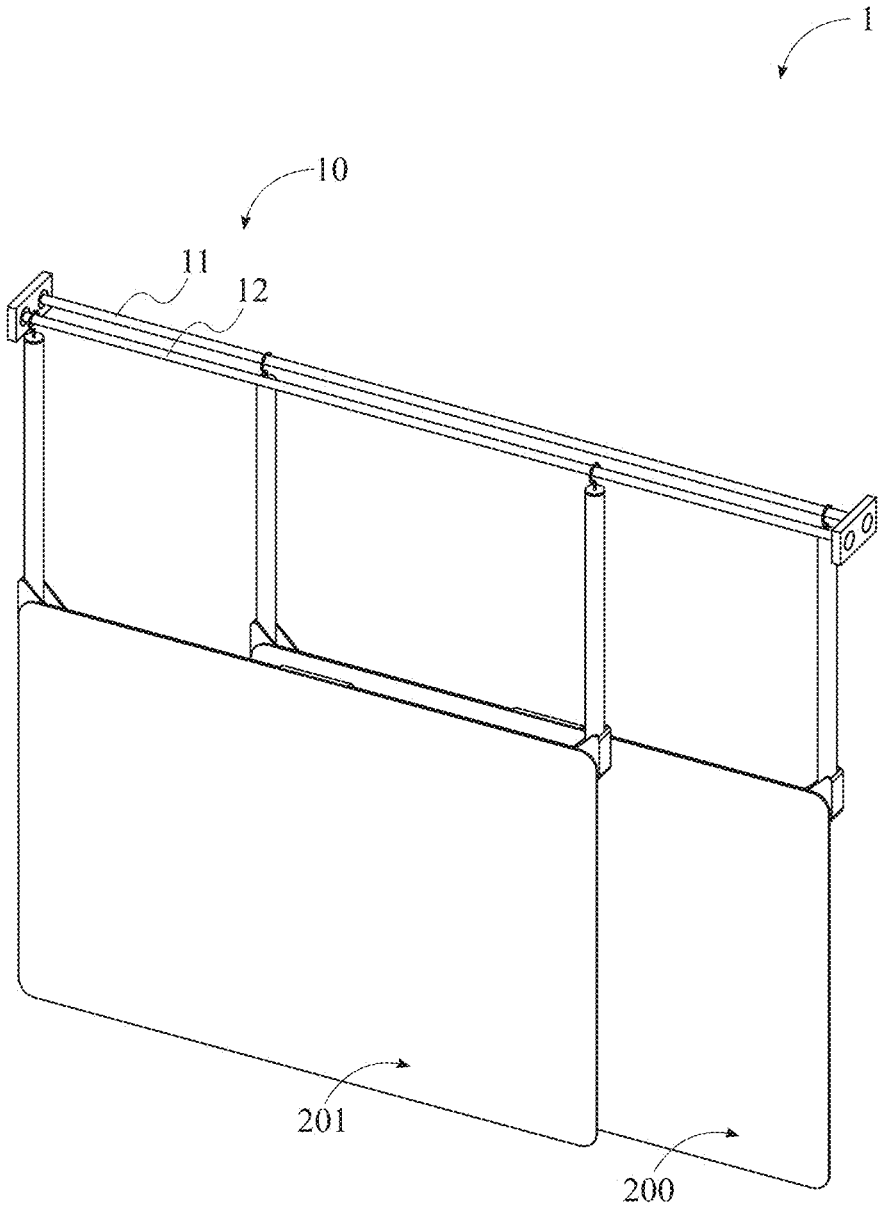
FIG. 13 is a perspective view of an alternate embodiment of the present invention comprising a plurality of shower rods and a plurality of divider assemblies.

Additionally, as shown in FIG. 13, the first horizontal member comprises a first end and a second end wherein said first end and second end of the first vertical member are opposing distal ends such that the first end of the first horizontal member is coupled to the first hinge and the second end of the first horizontal member extends inwardly within the preferred embodiment of the present invention, the at least one shower rod comprises a first shower rod and a second shower rod wherein said first and second shower rods are offset parallel to one another. Furthermore, in the preferred embodiment of the present invention, the at least one divider assembly comprises a first divider assembly and a second divider assembly. In the preferred embodiment of the present invention, the first divider assembly engages with the first shower rod and the second divider assembly engages with the second shower rod.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

Although the invention has been explained in relation to its preferred embodiment, it is to be understood that many other possible modifications and variations can be made without departing from the spirit and scope of the invention.

What is claimed is:

1. A shower screen device, comprising:

at least one shower rod;

at least one divider assembly;

wherein:

the at least one divider assembly slidably couples to the at least one shower rod such that the at least one divider assembly is translatable along the at least one shower rod;

the at least one divider assembly comprises:

a plurality of vertical elongated members;

a plurality of hinges;

a plurality of horizontal members; and a panel;

wherein:

the plurality of vertical members comprises a first vertical member and a second vertical member;

the plurality of horizontal members comprises a first horizontal member and a second horizontal member;

the plurality of hinges comprises a first hinge and a second hinge;

the first vertical member and the first horizontal member are contained within the first hinge such that the first hinge facilitates hinged movement of the first horizontal member relative to the first vertical member;

the second vertical member and the second horizontal member are contained within the second hinge such that the second hinge facilitates hinged movement of the second horizontal member relative to the second vertical member;

the panel being removably fixed along the plurality of horizontal members such that the panel is held taut along at least one edge of the panel.

2. The shower screen device, as claimed in claim 1, wherein:

each vertical member comprises a first distal end and a second distal end;

each horizontal member comprises a first distal end and a second end;

the first distal end of each vertical member comprises a translatory attachment mechanism;

the second distal end of each vertical member is hingedly coupled to the respective hinge;

the first end of each horizontal member being hingedly coupled to the respective hinge; and the second end of the first horizontal member being adjustably coupled to the second end of the second horizontal member.

3. The shower screen device, as claimed in claim 2, wherein the translatory attachment mechanism comprises a rod interface;

the rod interface engages with the at least one shower rod, facilitating translatory movement of the at least one divider assembly along the respective shower rod; and the rod interface being selected from:

a hook; and a caster.

4. The shower screen device, as claimed in claim 2, further comprising a connection member wherein said connection member joins the second end of the first horizontal member to the second end of the second horizontal member.

5. The shower screen device, as claimed in claim 4, further comprising a shelving unit;

the shelving unit comprising:

at least one attachment member; and a platform;

wherein:

the at least one platform extends horizontally from the at least one attachment member; and the at least one attachment member is held by the plurality of horizontal members.

6. The shower screen device, as claimed in claim 1, wherein each hinge of the plurality of hinges comprises a fixed degrees of freedom such that a maximum angle between one of the vertical members and the respective horizontal member is 90 degrees.

7. The shower screen device, as claimed in claim 6, comprising a window wherein said window is a rectangular opening formed by the plurality of vertical members, the at least one shower rod, and the plurality horizontal members.

8. The shower screen device, as claimed in claim 1, wherein the panel is composed of non-porous material.

9. The shower screen device, as claimed in claim 8, wherein the panel comprises a plurality of fasteners;

each fastener of the plurality of fasteners is offset from an adjacent fastener of the plurality of fasteners along a topmost edge of the panel; and the plurality of fasteners provides a fixed connection of the panel along the plurality of horizontal members.

10. The shower screen device as claimed in claim 1, wherein:

each vertical member is composed of a single linearly shaped elongated member such that a first distal end and a second distal end of the respective vertical member are opposing distal ends, separated by a proximal portion.

11. The shower screen device, as claimed in claim 1, wherein the panel comprises a topmost edge such that the topmost edge of the panel is maintained parallel to the plurality of horizontal members.

12. A shower screen device, comprising:

at least one shower rod;

at least one divider assembly;

wherein:

the at least one shower rod is an elongated tubular member comprising a first distal end, a second distal end, and a proximal portion wherein:

the first distal end and the second distal end are opposing distal ends of the at least one shower rod; and the proximal portion of the at least one shower rod extends between opposing distal ends; and the at least one divider assembly slidably couples to the at least one shower rod such that the at least one divider assembly is translatable along the at least one shower rod;

the at least one divider assembly comprises:

a plurality of translatory attachment mechanisms;

a plurality of vertical elongated members;

a plurality of hinges;

a plurality of horizontal members; and a panel;

wherein:

the plurality of vertical members comprises a first vertical member and a second vertical member;

the first vertical member comprises a first end and a second end;

the second vertical member comprises a first end and a second end;

the first end of each vertical member extends towards the at least one shower rod;

the plurality of horizontal members is interposed between the second end of each vertical member;

the plurality of hinges joining the plurality of horizontal members to the second end of each vertical member such that each hinge facilitates axial rotation between the plurality of vertical members and the plurality of horizontal members;

the panel being removably fixed along the plurality of horizontal members such that the panel is held taut along at least one edge of the panel;

the plurality of translatory attachment mechanisms being coupled to the plurality of vertical members such that the first end of each vertical member comprises a translatory attachment mechanism; and each translatory attachment mechanism enables translatory movement of the at least one divider assembly along the at least one shower rod in between the first distal end and the second distal end of the respective shower rod.

13. The shower screen device, as claimed in claim 12, wherein:

the at least one shower rod comprising a first shower rod and a second shower rod;

the at least one divider assembly comprising a first divider assembly and a second divider assembly;

the first divider assembly coupled to the first shower rod;

the second divider assembly coupled to the second shower rod; and the first shower rod and the second shower rod being offset parallel to each other.

14. The shower screen device, as claimed in claim 13, wherein each panel is a non-porous rectangular sheet comprising a topmost edge such that the topmost edge of the panel is maintained parallel to the plurality of horizontal members.

15. The shower screen device as claimed in claim 13, wherein:

each vertical member is composed of a single linearly shaped elongated member such that the first distal end and the second distal end of the respective vertical member are opposing distal ends, separated by a proximal portion.

16. The shower screen device, as claimed in claim 12, wherein each translatory attachment mechanism comprises:

a connector; and a rod interface;

wherein:

the connector couples each translatory attachment mechanism to the respective vertical member; and the rod interface engages with the respective shower rod to facilitate translatory movement along said respective shower rod.

17. The shower screen device, as claimed in claim 16, wherein the rod interface is selected from:

a hook; and a caster.

18. A shower screen device, comprising:

at least one shower rod;

at least one divider assembly; and a window;

wherein:

the at least one divider assembly slidably couples to the at least one shower rod such that the at least one divider assembly is translatable along the at least one shower rod;

the at least one divider assembly comprises:

a plurality of vertical elongated members;

a plurality of hinges;

a plurality of horizontal members; and a panel;

wherein:

the plurality of vertical members comprises a first vertical member and a second vertical member;

the plurality of horizontal members comprises a first horizontal member and a second horizontal member;

the plurality of hinges comprises a first hinge and a second hinge;

the first vertical member and the first horizontal member are contained within the first hinge such that the first hinge facilitates hinged movement of the first horizontal member relative to the first vertical member;

the second vertical member and the second horizontal member are contained within the second hinge such that the second hinge facilitates hinged movement of the second horizontal member relative to the second vertical member;

the panel is composed of non-porous material;

the panel being removably fixed along the plurality of horizontal members such that the panel is held taut along at least one edge of the panel;

the window is a rectangular opening formed by the plurality of vertical members, the at least one shower rod, and the plurality horizontal members, such that airflow is not constricted when passing through the window.

19. The shower screen device as claimed in claim 18, wherein:

each vertical member is composed of a single linearly shaped elongated member such that a first distal end and a second distal end of the respective vertical member are opposing distal ends, separated by a proximal portion.

20. The shower screen device, as claimed in claim 19, wherein:

the at least one shower rod comprising a first shower rod and a second shower rod;

the at least one divider assembly comprising a first divider assembly and a second divider assembly;

the first divider assembly coupled to the first shower rod;

the second divider assembly coupled to the second shower rod; and the first shower rod and the second shower rod being offset parallel to each other.

* * * * *